US007261389B2

(12) United States Patent
Merz et al.

(10) Patent No.: US 7,261,389 B2
(45) Date of Patent: Aug. 28, 2007

(54) SYSTEMS AND METHODS FOR DISSIPATING HEAT INTO A FLUID EJECTOR CARRIAGE DEVICE

(75) Inventors: Eric A. Merz, Palmyra, NY (US); Roger G. Markham, Webster, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 301 days.

(21) Appl. No.: 10/721,221

(22) Filed: Nov. 26, 2003

(65) Prior Publication Data

US 2005/0110820 A1 May 26, 2005

(51) Int. Cl.
*B41J 29/377* (2006.01)
*B41J 23/00* (2006.01)
*B41J 25/304* (2006.01)

(52) U.S. Cl. ..... 347/18; 347/37; 400/320

(58) Field of Classification Search ..... 347/18, 347/37; 400/320
See application file for complete search history.

(56) References Cited

U.S. PATENT DOCUMENTS

| | | | | |
|---|---|---|---|---|
| 5,059,046 | A * | 10/1991 | Tanuma et al. | 400/320 |
| 5,880,754 | A * | 3/1999 | Niikura et al. | 347/18 |
| 6,305,786 | B1 * | 10/2001 | Plotkin et al. | 347/50 |
| 6,343,848 | B2 * | 2/2002 | Berg et al. | 347/18 |
| 6,391,082 | B1 * | 5/2002 | Holl | 75/230 |
| 6,820,959 | B1 * | 11/2004 | Spitz et al. | 347/18 |
| 6,908,170 | B2 * | 6/2005 | Merz | 347/18 |
| 2002/0001020 | A1 * | 1/2002 | Mrvos et al. | 347/65 |
| 2003/0052933 | A1 * | 3/2003 | Shoji | 347/16 |
| 2003/0197767 | A1 * | 10/2003 | Dudenhoefer et al. | 347/93 |

(Continued)

FOREIGN PATENT DOCUMENTS

EP 1078769 A2 * 2/2001

(Continued)

OTHER PUBLICATIONS

Yaws, C.L. (1999). Chemical Properties Handbook , McGraw-Hill. Online version available at: http://www.knovel.com/knovel2/Toc.jsp?BookID=49&VerticalID=0; Thermal Conductivity of Liquid and Solid Inorganic Compounds Table.*

(Continued)

*Primary Examiner*—Stephen Meier
*Assistant Examiner*—Rene Garcia, Jr.
(74) *Attorney, Agent, or Firm*—Oliff & Berridge, PLC

(57) ABSTRACT

A thermally-conductive fluid ejector carriage device is used to dissipate heat from a thermal fluid ejector module in a fluid ejection device. The thermally-conductive fluid ejector carriage device is molded from a polymer, or a polymer material including at least one thermally-conductive filler material. The thermal fluid ejector module is brought into contact with the thermally-conducting polymer carriage to dissipate heat. The polymer can be a highly thermally-conductive polymer. A method of manufacturing the thermally-conductive polymer carriage includes molding the carriage at least partially from a polymer that includes thermally-conductive filler materials, and contacting the thermally-conducting polymer carriage with the fluid ejector module. A method for use of the thermally-conductive fluid ejector carriage device includes establishing a heat flow path from the fluid ejector module to ambient air through the thermally-conductive fluid ejector carriage device.

41 Claims, 3 Drawing Sheets

U.S. PATENT DOCUMENTS

| | | | | |
|---|---|---|---|---|
| 2005/0024457 | A1* | 2/2005 | Hilton et al. | 347/87 |
| 2005/0109768 | A1* | 5/2005 | Miller et al. | 219/535 |
| 2005/0110820 | A1* | 5/2005 | Merz et al. | 347/18 |
| 2006/0040122 | A1* | 2/2006 | Dean et al. | 428/447 |

FOREIGN PATENT DOCUMENTS

| | | | |
|---|---|---|---|
| JP | 04113856 | A * | 4/1992 |
| JP | 06024097 | A * | 2/1994 |

OTHER PUBLICATIONS

Selected pages form Cool Polymers. Inc. Website (www.coolpolymers.com), Mar. 3, 2003 including Thermally Conductive Polymers.*

Cool Polymers, Inc., Website (www.coolpolymers.com), Nov. 26, 2003, including product descriptive pages directed to Cool Poly®E2 Series Thermally Conductive Liquid Crystalline Polymer, Processing Guidelines and Application Reviews.

* cited by examiner

SYSTEMS AND METHODS FOR DISSIPATING HEAT INTO A FLUID EJECTOR CARRIAGE DEVICE

BACKGROUND OF THE INVENTION

1. Field of Invention

This is invention is directed to systems, methods and structures for dissipating heat in fluid ejector heads.

2. Description of Related Art

A variety of systems, methods and structures are conventionally used to dissipate heat in a thermal fluid ejector head. The thermal fluid ejector heads of fluid ejection devices, such as, for example, ink jet printers, generate significant amounts of residual heat as the fluid is ejected by heating the fluid to the point of vaporization. This residual heat will change the performance, and ultimately the ejection quality, if the excess heat remains within the fluid ejector head. Changes in ejector performance are normally manifested by a change in the drop size, firing sequence, or other related ejection metrics. Such ejection metrics desirably remain within a controllable range for acceptable ejection quality. During lengthy operation or heavy coverage ejection, the temperature of the thermal fluid ejector head can exceed an allowable temperature limit. Once the temperature limit is exceeded, a slow down or cool down period is normally used to maintain ejection quality.

Many fluid ejection devices, such as, for example, printers, copiers and the like, improve throughput by improving thermal performance. One technique to improve fluid ejector head performance is to divert excess heat into the fluid being ejected. Once the fluid being ejected has exceeded a predetermined temperature, the hot fluid is ejected from the fluid ejector head. During lengthy operation or heavy coverage ejection, this technique is also susceptible to temperatures in the fluid ejector head exceeding an allowable temperature.

Another technique is to use a heat sink to store heat, or conduct heat away, from the fluid ejector head. Typically, heat sinks are made from copper, aluminum or other materials having high thermal conductivity to remove heat from the thermal fluid ejector head. U.S. patent application Ser. No. 10/600,507, which is incorporated herein by reference in its entirety, discloses various exemplary embodiments of such heat sinks molded from a polymer mixed with at least one thermally-conductive filler material.

Heat sinks, however, add additional weight, size, cost and/or energy usage to the fluid ejector head. Each of these becomes disadvantageous when in heat sinks applied to fluid ejector heads that are translated past a receiving medium. Additionally, many fluids typically employed in fluid ejector heads, such as inks, use solvents and/or salts which are likely to corrode aluminum, copper and other like heat sink materials.

SUMMARY OF THE INVENTION

This invention provides systems, methods and structures that dissipate heat in a thermal fluid ejector head.

This invention separately provides systems, methods and structures that transfer heat from a fluid ejector head into a thermally-conductive carriage device used to support the fluid ejector head.

This invention separately provides systems, methods and structures that obtain better thermal conductivity in a highly thermally-conductive carriage device made from a polymer.

In various exemplary embodiments of the systems, methods and structures according to this invention, a highly thermally-conductive carriage device, which, in various exemplary embodiments, is molded from a polymer, or a polymer material having at least one thermally-conductive filler material, is used to cool one or more fluid ejector head assemblies. In various exemplary embodiments of the systems, methods and structures according to this invention, thermally-conductive fluid ejector carriage devices and fluid ejector modules containing the actual heater elements of the fluid ejector head are made of materials having similar coefficients of thermal expansion.

In various exemplary embodiments of the systems, methods and structures according to this invention, thermally-conductive polymer materials are used to mold fluid ejector carriage devices. Use of thermally-conductive polymers in such structures is advantageous because these materials are lighter in weight and more resistant to corrosion. Further, thermally-conductive polymers are easily molded into complex shapes, including integral heat sink surfaces that maximize the total surface area of the fluid ejector carriage device to support heat dissipation to surrounding ambient air.

In various exemplary embodiments of the systems, methods and structures according to this invention, thermally-conductive carriage devices and thermal fluid ejector heads (either standing alone or as part of a thermal fluid ejector head print cartridge) are brought into contact with each other such that a sufficient heat flow path is established to dissipate heat from the thermal fluid ejector head into the thermally-conductive carriage device. The thermally-conductive carriage device can then transfer heat to ambient air as the thermally-conductive carriage device translates past the receiving medium.

In various exemplary embodiments of the systems, methods and structures according to this invention, contact between any separate thermally-conductive structures or elements, such as, for example, between the thermally-conductive carriage device and the fluid ejector head, is augmented with the use of compliant, thermally-conductive pads, and/or phase change or other thermally-conductive heat sink compounds, and/or other like devices or materials that enhance the thermal path between the individual thermally-conductive structures or elements. In various exemplary embodiments of the systems, methods and structures according to this invention, contact is achieved and/or enhanced by establishing a temporary or permanent physical bond between a thermally-conductive carriage device and a fluid ejector head. In various exemplary embodiments of the systems, methods and structures according to this invention, one or more additional mechanical structures and/or devices usable to enhance the contact between a thermally-conductive carriage device and a fluid ejector head are added.

These and other features and advantages of the disclosed embodiments are described in, or are apparent from, the following detailed description of various exemplary embodiments of the systems, methods and structures according to this invention.

BRIEF DESCRIPTION OF THE DRAWINGS

Various exemplary embodiments of the invention will be described in detail, with reference to the following figures, wherein.

DETAILED DESCRIPTION OF EXEMPLARY EMBODIMENTS

Figure 1:
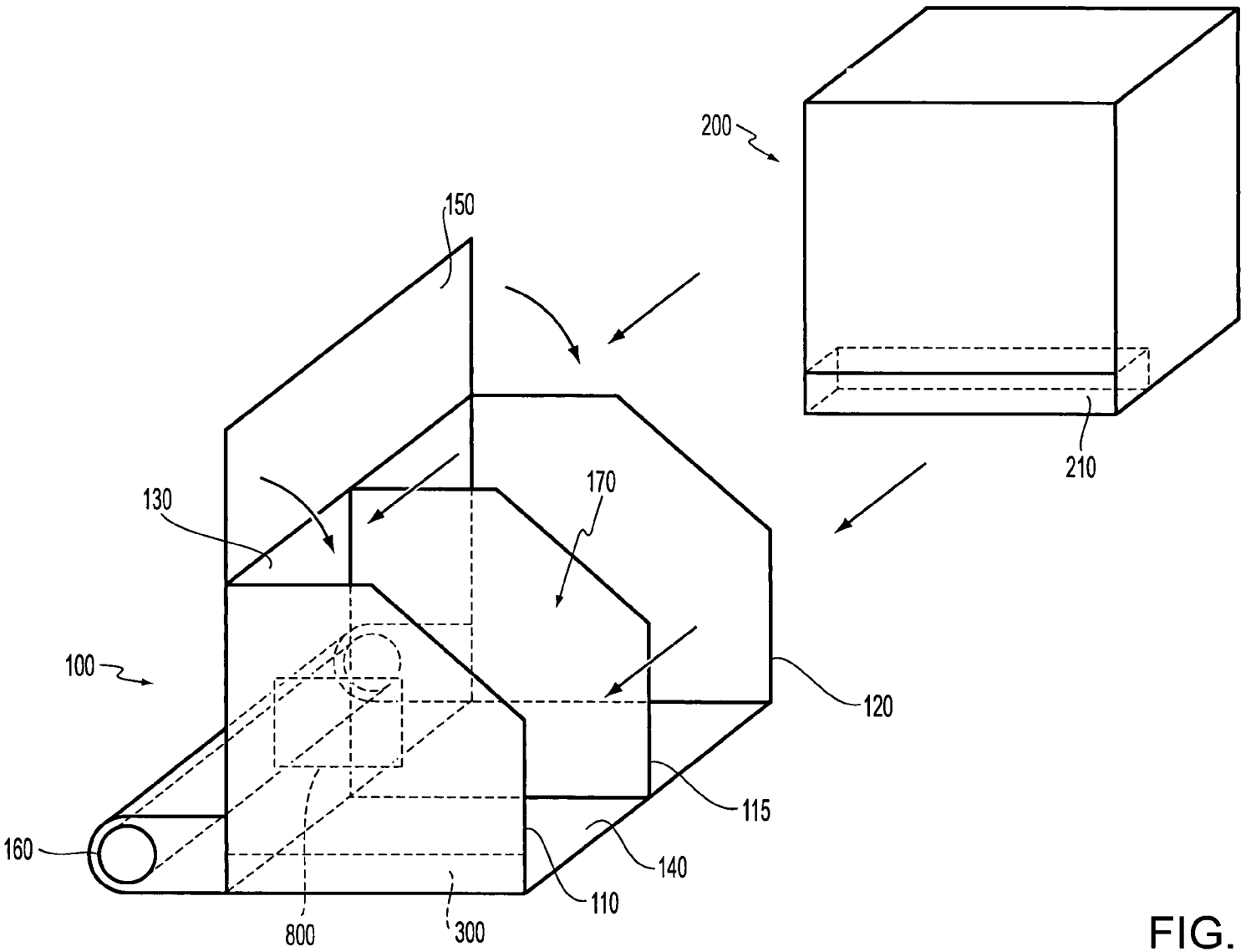
FIG. 1 illustrates a first exemplary embodiment of a thermally-conductive carriage usable with various exemplary embodiments of the systems, methods and structures according to this invention.

The following detailed description of various exemplary embodiments of the fluid ejection systems according to this invention may refer to and/or illustrate one specific type of fluid ejection system, a thermal ink jet printer, for the sake of clarity and familiarity. However, it should be appreciated that the principles of this invention, as outlined and/or discussed below, can be equally applied to any known or later-developed fluid ejection systems beyond the ink jet printer specifically discussed herein.

Various exemplary embodiments of the systems, methods and structures according to this invention enable heat dissipation from fluid ejector heads, such as, for example, those found in thermal ink jet printers, copiers and/or facsimile machines, by using one or more thermally-conductive materials to form a thermally-conductive fluid ejector carriage device in which various components of the fluid ejection system are housed. In various exemplary embodiments, the systems, methods and structures according to this invention provide thermally-conductive fluid ejector carriage devices formed using a polymer material that can include one or more filler materials with properties that allow the thermally-conductive polymer carriage devices to more readily dissipate heat.

In various exemplary embodiments, a thermally-conductive fluid ejector carriage device according to this invention is manufactured, or molded, using a highly thermally-conductive polymer. The highly thermally-conductive polymer has thermal conductivity in the range of about 10 W/m° C. to 100 W/m° C. This thermal conductivity is typically in the range of 50–500 times greater than that of standard plastics, which range from 0.1–0.3 W/m° C. The highly thermally-conductive polymer has a thermal conductivity which is close to the thermal conductivity of aluminum. The thermal conductivity of aluminum is about 100–150 W/m° C. These polymers are also easily injection molded into shapes tending to maximize the surface area, and thus the heat dissipation capacity, of any molded components, including thermally-conductive fluid ejector carriage devices.

Thermally-conductive components, such as fluid ejector cartridge carriages, are used to carry heat away from a die, or other heater element, of a thermal fluid ejector head, allowing the fluid ejector head to operate in an acceptable temperature range for extended periods of time. Operating a fluid ejector head for extended periods of time typically increases the temperatures in the die of the fluid ejector head. Dissipating the heat away from the die allows the fluid ejector head to operate at temperatures cool enough to enable consistent high quality fluid ejection.

In various exemplary embodiments according to this invention, highly thermally-conductive polymers are used for the carriage material and, in various exemplary embodiments, include base polymers mixed with a variety of filler materials. For example, one such polymer material is COOL POLY™ made by Cool Polymers, Inc. Specifically, COOL POLY E200™ polymer material is an injection-moldable, liquid crystalline polymer (LCP) based material having a thermal conductivity of about 60 W/m° C.

Other companies, such as Polyone, LDP Engineering Plastics, RTP Company, GE and Dupont, have developed highly thermally-conductive polymers that may also be used in forming thermally-conductive fluid ejector carriage devices according to this invention.

Typical filler materials include graphite fibers and ceramic materials such as boron, nitride and aluminum nitride fibers. In various exemplary embodiments, blends of highly thermally-conductive polymers use graphite fibers formed from a petroleum pitch base material. Typical base materials for the polymers include LCP, polyphenylene sulfide and polysulfone.

In various exemplary embodiments, in order to effect a satisfactory thermally-conductive path from the heater element to the thermally-conductive fluid ejector carriage device, it may be advantageous to form at least a temporary bond between the thermal fluid ejector head and the thermally-conductive fluid ejector carriage device. It is generally desirable to reduce, and ideally minimize, the shear force between the fluid ejector head and the thermally-conductive fluid ejector carriage device. This reduction in shear force is accomplished by matching the coefficients of thermal expansion of the materials used to form the bonded elements. The die of the fluid ejector head is typically made from silicon, which has a coefficient of thermal expansion of 4.67 μm/m° C. and characteristic polymer materials have coefficient of thermal expansion (parallel to the flow) of about 5 μm/m per ° C.

FIG. 1 illustrates a first exemplary embodiment of a thermally-conductive fluid ejector carriage device 100 usable with various exemplary embodiments of the systems, methods and structures according to this invention. As shown in FIG. 1, the thermally-conductive fluid ejector carriage device 100 is usable to dissipate heat from a fluid ejector print cartridge 200.

In various exemplary embodiments, the thermally-conductive fluid ejector carriage device 100 includes at least one receiving area 170 to house a fluid ejector head print cartridge 200, a carriage face 130, a carriage base 140, a fixed or movable carriage top 150 available as an exemplary means for securing the fluid ejector print cartridge 200 in place. The receiving area 170 is bounded by side walls 110 and 120 (with provision for internal dividing walls 115). In the exemplary embodiment of the thermally-conductive fluid ejector carriage device 100 shown in FIG. 1, the side wall 110, the internal dividing wall 115, the front face 130 and the carriage base 140 define the receiving area 170 that is used to receive the exemplary print cartridge 200.

In various exemplary embodiments, the thermally-conductive fluid ejector carriage device 100 also includes at least one thermally-conductive interface structure 160 between the thermally-conductive fluid ejector carriage device 100 and at least one structure upon which the thermally-conductive fluid ejector carriage device translates (not shown). Such interface is depicted in FIG. 1, and will be referred to as an exemplary interface throughout, as a thermally-conductive carriage rod guide 160. It should be appreciated that although exemplary embodiments of a structural interface 160 and a structure upon which the thermally-conductive fluid ejector carriage device translates are discussed as a carriage rod guide and a carriage guide rod, respectively, these descriptions are illustrative and in no way limiting.

In various exemplary embodiments, the fluid ejector print cartridge 200 contains the thermal fluid ejector head 210. While depicted in FIG. 1 as being mounted integrally into the side face of the exemplary print cartridge 200, it should be appreciated that the thermal fluid ejector head 210 may be mounted in, or attached externally to, any appropriate face of the fluid ejector print cartridge 200. It is generally desirable that the placement of the thermal fluid ejector head 210 on the fluid ejector print cartridge 200 facilitate at least indirect contact between the thermal fluid ejector head 210 and the thermally-conductive fluid ejector carriage device 100. In the exemplary embodiment of the thermally-conductive fluid ejector carriage device 100 depicted in FIG. 1, the thermally-conductive fluid ejector carriage device 100 includes a contact area 300 between the thermal fluid ejector head 210 and the thermally-conductive fluid ejector carriage device 100.

In various exemplary embodiments, at least one thermally-conductive heat sink can be added, for example, by being molded into, or attached onto, the thermally-conductive fluid ejector carriage device 100, to dissipate additional heat. An exemplary placement area 800 for such an additional heat sink is shown in FIG. 1.

Figure 2:
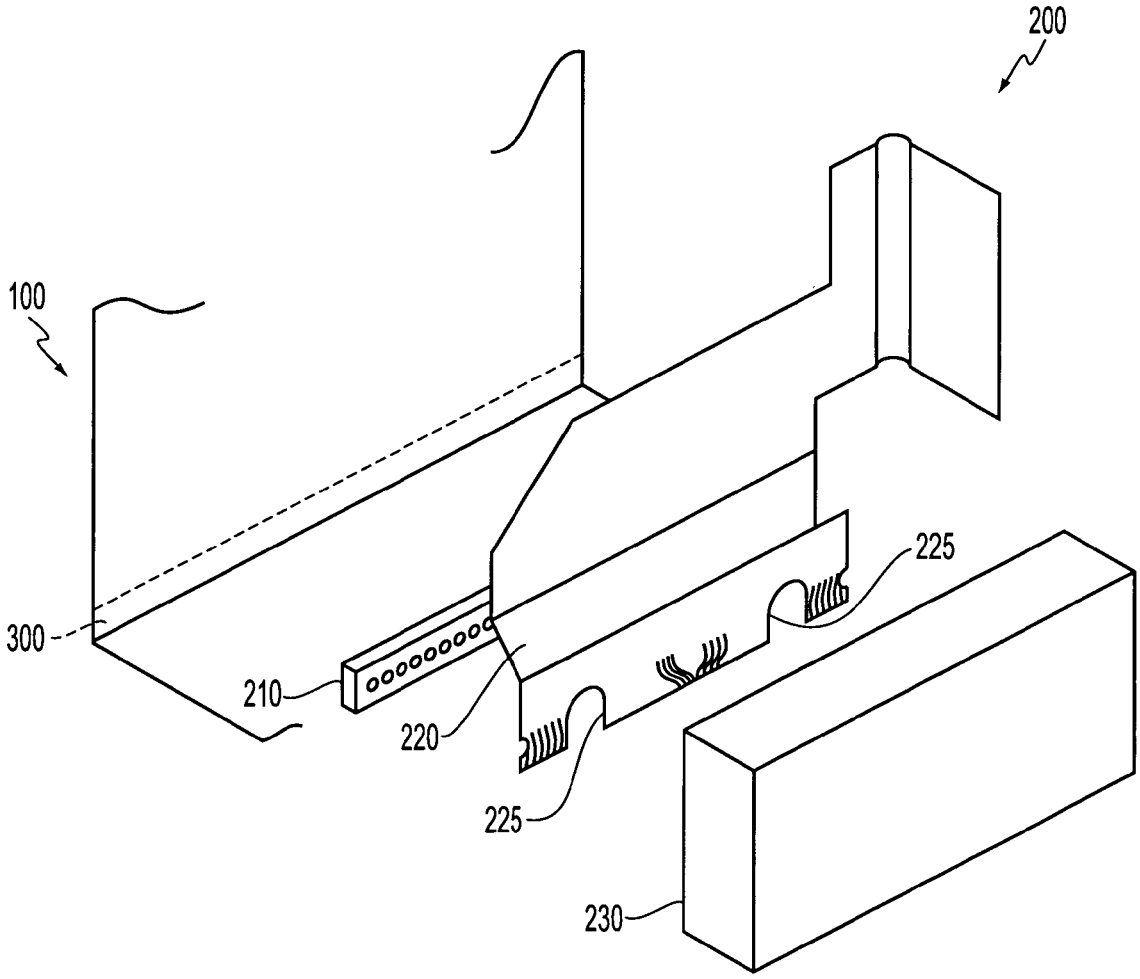
FIG. 2 illustrates a first exemplary embodiment of a fluid ejector print cartridge usable with various exemplary embodiments of the systems, methods and structures according to this invention.

FIG. 2 illustrates a first exemplary embodiment of the fluid ejector print cartridge 200 usable with various exemplary embodiments of the systems, methods and structures according to this invention. As shown in FIG. 2, the fluid ejector print cartridge 200 includes a thermal fluid ejector head 210 containing the actual heater elements and a printed wiring member 220. In various exemplary embodiments, the fluid ejector print cartridge 200 may also include a fluid supply cartridge or tank 230.

In various exemplary embodiments, the fluid supply cartridge or tank 230 is formed using a molded polymer containing at least one thermally-conductive filler material to provide additional surface area for heat dissipation beyond that provided by the thermally-conductive fluid ejector carriage device 100. U.S. patent application Ser. No. 10/629,606, which is incorporated herein by reference in its entirety, discloses various exemplary embodiments of such a thermally-conductive polymer fluid supply cartridge or tank.

In various exemplary embodiments, the thermal fluid ejector head 210 is attached to the printed wiring member 220. The fluid ejector print cartridge 200 to which the thermal fluid ejector head 210 and the printed wiring member 220 are attached is inserted into a suitably sized receiving area, such as the receiving area 170 shown in FIG. 1, of the thermally-conductive fluid ejector carriage device 100 in such a manner that the thermal fluid ejector head 210 is exposed to, and brought into contact with, the associated contact area 300 that is provided on an internal face in the receiving area 170 of the thermally-conductive fluid ejector carriage device 100. Sufficient contact provides an adequate heat flow path from the heater element contained in the thermal fluid ejector head 210 to the thermally-conductive fluid ejector carriage device 100 to dissipate heat. It should be appreciated that, though depicted in FIGS. 1 and 2 as integral to a fluid ejector cartridge, such as the fluid ejector cartridge 200 in FIG. 1, the fluid ejector head 210 and attached printed wiring member 220, could be inserted, installed, or otherwise brought into contact with a suitably sized receiving area, such as the receiving area 170 shown in FIG. 1, in the thermally-conductive fluid ejector carriage device 100 as stand-alone elements.

In various exemplary embodiments, the printed wiring member 220 includes electrically conductive traces formed on a substrate. The traces have contact pads at one end and contact areas at an opposite end. The contact pads are sized and shaped to be connected to an electrical connector. The printed wiring member 220 also has through holes 225 that provide access for additional mechanical structures and/or devices designed to facilitate and/or enhance the contact between the thermal fluid ejector head 210 and the contact area 300 of the thermally-conductive fluid ejector carriage device 100. Such mechanical structures and/or devices include, but are not limited to, screws, springs, clamps, wedges or other structures and/or devices introduced, for example, to increase the pressure of the contact between the thermal fluid ejector head 210 and the contact area 300 of the thermally-conductive fluid ejector carriage device 100.

Figure 3:
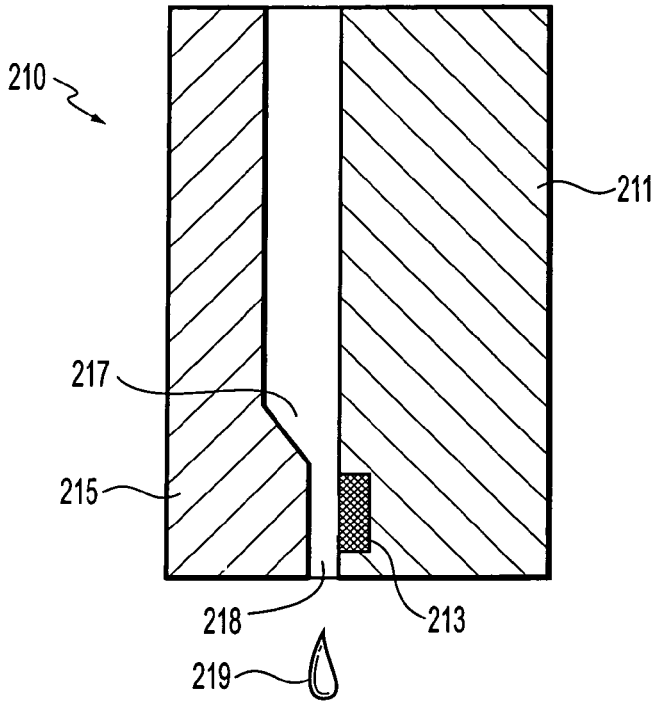
FIG. 3 is a cross-sectional view illustrating a first exemplary embodiment of a fluid ejector element usable with various exemplary embodiments of the systems, methods and structures according to this invention.

FIG. 3 is a cross-sectional view illustrating a first exemplary embodiment of the thermal fluid ejector head 210 usable with various exemplary embodiments of the systems, methods and structures according to this invention. As shown in FIG. 3, various exemplary embodiments of the thermal fluid ejector head include a heater element substrate 211 having a heater element 213 formed on the heater element substrate 211. The heater element substrate 211 is attached to a liquid path substrate 215 to provide a fluid channel 217 and a fluid outlet 218. In various exemplary embodiments, wafers containing multiple instances of the heater element substrate 211 and the liquid path substrate 215 are registered and bonded. The thermal fluid ejector head 210 is then cut and separated from the bonded wafers. The thermal fluid ejector head 210 is attached to a printed wiring member, such as, for example, the printed wiring member 220 shown in FIG. 2, to connect the heater element 213 of the thermal fluid ejector head 210 to external control and/or power circuits.

In various exemplary embodiments, fluid is distributed to each of a plurality of channels 217 from a fluid supply source (not shown) via a manifold (not shown). The pressure of bubbles developed in the channels 217 by the heater element 213 heating the fluid in the channels 217 ejects liquid drops 219 from the outlet 218 and onto a receiving medium.

Figure 4:
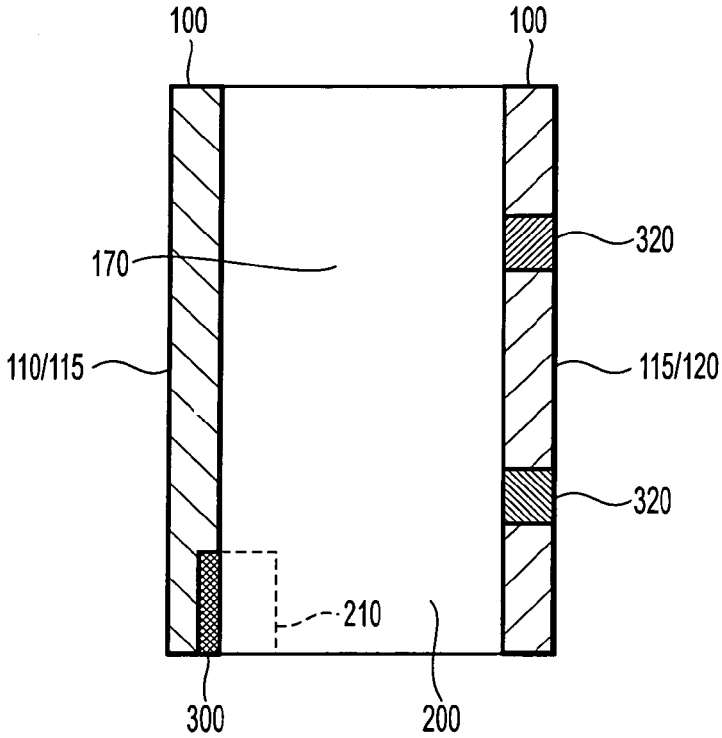
FIG. 4 is a cross-sectional view illustrating a second exemplary embodiment of a fluid ejector print cartridge mounted in a thermally-conductive carriage usable with various exemplary embodiments of the systems, methods and structures according to this invention.

FIG. 4 is a cross-sectional view illustrating a second exemplary embodiment of a fluid ejector print cartridge 200 mounted in a thermally-conductive fluid ejector carriage device 100 usable with various exemplary embodiments of the systems, methods and structures according to this invention. As shown in FIG. 4, the fluid ejector print cartridge 200 is inserted between the side wall 110 and the internal dividing wall 115 (or alternatively between the internal dividing wall 115 and the side wall 120) that define an appropriately sized receiving area 170 in the thermally-conductive fluid ejector carriage device 100. In various exemplary embodiments, the thermal fluid ejector head 210 contacts a suitable contact area 300 provided on one or more suitable inside faces of the receiving area 170 of the thermally-conductive fluid ejector carriage device 100 to provide an adequate heat flow path to dissipate heat from the thermal fluid ejector head 210 into the thermally-conductive fluid ejector carriage device 100.

In various exemplary embodiments, the contact between the thermal fluid ejector head 210 and the contact area 300 of the thermally-conductive fluid ejector carriage device 100 is augmented with the use of a compliant, thermally-conductive pad, and/or a phase-change or other thermally-conductive heat sink compound, and/or any other appropriate device or material usable either to conduct heat and/or to enhance the thermal path between the thermal fluid ejector head 210 and the thermally-conductive fluid ejector carriage device 100. In various exemplary embodiments, at least a temporary physical bond is established between the thermal fluid ejector head 210 and the contact area 300 to enhance the thermal path between the thermal fluid ejector head 210 and the thermally-conductive fluid ejector carriage device 100.

In various exemplary embodiments, one or more structures 320 are provided on the thermally-conductive fluid ejector carriage device 100, or alternatively on the fluid ejector print cartridge 200, that allow additional mechanical structures and/or devices to be added that operate to enhance the contact between the thermal fluid ejector head 210 and the contact area 300 to provide a sufficient heat flow path for dissipating heat from the thermal fluid ejector head 210 into the thermally-conductive fluid ejector carriage device 100. Such mechanical structures and/or devices include, but are not limited to, screws, springs, clamps, wedges and/or any other appropriate mechanical structure and/or device usable to exert additional pressure on, and/or otherwise enhance the physical contact between, the side walls 110 or 120, or the internal dividing walls 115, of the receiving area 170 and the fluid ejector print cartridge 200, or thermal fluid ejector head 210 and printed wiring member 220 as stand-alone elements.

It should be appreciated that other structures and/or devices usable to insure sufficient contact between the thermal fluid ejector head 210 and the contact area 300 that will provide, augment, and/or enhance the heat flow path between the thermal fluid ejector head 210 and the thermally-conductive fluid ejector carriage device 100 may be added.

It should be further appreciated that a compliant, thermally-conductive pad, and/or a phase-change or other thermally-conductive heat sink compound, and/or any other appropriate device or material usable either to conduct heat and/or to enhance the thermal path discussed above may be introduced to conduct heat and/or to enhance the thermal contact between any of the separate elements that comprise the heat flow path from the fluid ejector module to ambient air.

While this invention has been described in conjunction with the exemplary embodiments outlined above, various alternatives, modifications, variations, improvements, and/or substantial equivalents, whether known or that are, or may be, presently unforeseen, may become apparent to those having at least ordinary skill in the art. Accordingly the exemplary embodiments of the invention, as set forth above, are intended to be illustrative, not limiting. Various changes may be made without departing from the spirit and scope of the invention. Therefore, the systems, methods and devices according to this invention are intended to embrace all known or later-developed alternatives, modifications, variations, improvements, and/or substantial equivalents.

What is claimed is:

1. A fluid ejector carriage assembly, comprising:

a thermally-conductive fluid ejector carriage device; and a fluid ejector module in thermal contact with the thermally-conductive fluid ejector carriage device, wherein the thermally-conductive fluid ejector carriage device consists essentially of a polymer material, the polymer material comprising:

at least a base polymer; and at least one thermally-conductive filler material mixed in the at least the base polymer material, and wherein the thermally-conductive fluid ejector carriage device comprises a receiving area usable to receive a cartridge comprising a container that stores a fluid to be ejected by the fluid ejector module in contact with the fluid ejector module.

2. The fluid ejector carriage assembly of claim 1, wherein the at least one thermally-conductive filler material has a thermal conductivity greater than about 10 W/m° C.

3. The fluid ejector carriage assembly of claim 1, wherein the at least one thermally-conductive filler material has a thermal conductivity less than about 100 W/m° C.

4. The fluid ejector carriage assembly of claim 3, wherein the at least one thermally-conductive filler material has a thermal conductivity of greater than about 10 W/m° C.

5. The fluid ejector carriage assembly of claim 1, wherein the at least one thermally-conductive filler material is a graphite material.

6. The fluid ejector carriage assembly of claim 5, wherein the graphite material is formed using a petroleum pitch base material.

7. The fluid ejector carriage assembly of claim 1, wherein the at least one thermally-conductive filler material is a ceramic material.

8. The fluid ejector carriage assembly of claim 7, wherein the at least one ceramic material is at least one of boron nitride and aluminum nitride.

9. The fluid ejector carriage assembly of claim 1, wherein the base polymer is at least one of liquid crystal polymer, polyphenylene sulfide and polysulfone.

10. The fluid ejector carriage assembly of claim 1, wherein the base polymer is chemically resistant to ink.

11. The fluid ejector carriage assembly of claim 1, wherein the thermally-conductive fluid ejector carriage device and fluid ejector module are made of materials having similar coefficients of thermal expansion.

12. The fluid ejector carriage assembly of claim 1, wherein the contact between the thermally-conductive fluid ejector carriage device and the fluid ejector module is augmented with at least one compliant, thermally-conductive pad.

13. The fluid ejector carriage assembly of claim 1, wherein the contact between the thermally-conductive fluid ejector carriage device and the fluid ejector module is augmented with at least one thermally-conductive heat sink compound.

14. The fluid ejector carriage assembly of claim 1, wherein the contact between the thermally-conductive fluid ejector carriage device and the fluid ejector module comprises at least a temporary bond between the thermally-conductive fluid ejector carriage device and the fluid ejector module.

15. The fluid ejector carriage assembly of claim 1, wherein the contact between the thermally-conductive fluid ejector carriage device and the fluid ejector module is augmented with at least one mechanical device or structure.

16. The fluid ejector carriage assembly of claim 1, wherein the container that stores the fluid is molded from a thermally-conductive material and the contact between the container that stores fluid and the fluid ejector module establishes a heat flow path for heat dissipation.

17. The fluid ejector carriage assembly of claim 16, wherein the contact between the container that stores fluid and the fluid ejector module is augmented with at least one compliant, thermally-conductive pad.

18. The fluid ejector carriage assembly of claim 16, wherein the contact between the container that stores fluid and the fluid ejector module is augmented with at least one thermally-conductive heat sink compound.

19. The fluid ejector carriage assembly of claim 16, wherein the contact between the container that stores fluid and the fluid ejector module comprises at least a temporary bond between the container that stores fluid and the fluid ejector module.

20. The fluid ejector carriage assembly of claim 16, wherein the contact between the container that stores fluid and the fluid ejector module is augmented with at least one mechanical device or structure.

21. The fluid ejector carriage assembly of claim 1, wherein the thermally-conductive fluid ejector carriage device further comprises multiple receiving areas usable to receive multiple fluid ejector modules.

22. The fluid ejector carriage assembly of claim 21, wherein each receiving area is usable to receive a cartridge comprising a container that stores a fluid to be ejected by the fluid ejector module in contact with a fluid ejector module.

23. The fluid ejector carriage assembly of claim 1, wherein the thermally-conductive fluid ejector carriage device further comprises an integral molded heat sink.

24. A fluid ejector carriage assembly, comprising:

a thermally-conductive fluid ejector carriage device; and a fluid ejector module in thermal contact with the thermally-conductive fluid ejector carriage device, wherein the thermally-conductive fluid ejector carriage device is molded from a polymer material containing at least a base polymer and at least one thermally-conductive filler material, and the thermally-conductive fluid ejector carriage device comprises a receiving area usable to receive a cartridge comprising a container that stores a fluid to be ejected by the fluid ejector module in contact with the fluid ejector module, and a separate heat sink is mounted in contact with the thermally-conductive fluid ejector carriage device.

25. The fluid ejector carriage assembly of claim 24, wherein the contact between the thermally-conductive fluid ejector carriage device and the separately mounted heat sink is augmented with at least one compliant, thermally-conductive pad.

26. The fluid ejector carriage assembly of claim 24, wherein the contact between the thermally-conductive fluid ejector carriage device and the separately mounted heat sink is augmented with at least one thermally-conductive heat sink compound.

27. The fluid ejector carriage assembly of claim 24, wherein the contact between the thermally-conductive fluid ejector carnage device and the separately mounted heat sink comprises at least a temporary bond between the thermally-conductive fluid ejector carriage device and the separately mounted heat sink.

28. The fluid ejector carriage assembly of claim 24, wherein the contact between the thermally-conductive fluid ejector carriage device and the separately mounted heat sink is augmented with at least one mechanical device or structure.

29. A method for dissipating heat from a thermal fluid ejector module, comprising:

establishing a heat flow path from at least one thermal fluid ejector module through contact with a thermally-conductive polymer carriage device, the thermally-conductive polymer carriage device being molded from a polymer material containing at least a base polymer and at least one thermally-conductive filler material, and the thermally-conductive polymer carriage device being provided with at least one receiving area that is suitably sized to accept at least one integral print cartridge comprising a fluid ejector module assembly and a container that stores a fluid to be ejected by the fluid ejector module;

operating at least one thermal fluid ejector module in contact with the thermally-conductive polymer carriage device in a manner that generates excess heat in the fluid ejector module; and transferring the excess heat from the at least one thermal fluid ejector module to ambient air surrounding the thermally-conductive polymer carriage device through the heat flow path established by the contact between the at least one thermal fluid ejector module and the thermally-conductive polymer carriage device.

30. The method of claim 29, further comprising establishing contact between the thermal fluid ejector module and the thermally-conductive polymer carriage device by force-fitting at least one thermal fluid ejector module into a suitably sized receiving area in the thermally-conductive polymer carriage device so that the fluid ejector module is exposed to a suitable thermally-conductive contact area on an internal face of the receiving area.

31. The method of claim 30, wherein establishing the contact between the fluid ejector module and the thermally-conductive polymer carriage device further comprises forming at least a temporary bond between the fluid ejector module and the thermally-conductive polymer carriage device.

32. The method of claim 30, further comprising augmenting the contact between the fluid ejector module and the thermally-conductive polymer carriage device using at least one compliant, thermally-conductive pad.

33. The method of claim 30, further comprising augmenting the contact between the fluid ejector module and the thermally-conductive polymer carriage device using at least one thermally-conductive heat sink compound.

34. The method of claim 30, further comprising augmenting the contact between the fluid ejector module and the thermally-conductive polymer carriage device using at least one mechanical device or structure.

35. The method of claim 29, wherein establishing the heat flow path comprises establishing at least one heat flow path from the thermally-conductive polymer carriage device to at least one heat sink.

36. The method of claim 35, wherein establishing the at least one heat flow path from the thermally-conductive polymer carriage device to the at least one additional heat sink comprises integrally molding the at least one heat sink with the thermally-conductive polymer carriage device.

37. The method of claim 35, wherein establishing the at least one heat flow path from the thermally-conductive polymer carnage device to the at least one additional heat sink comprises mounting the at least one heat sink in contact with the thermally-conductive polymer carriage device.

38. The method of claim 37, wherein establishing the contact between the at least one heat sink and the thermally-conductive polymer carriage device further comprises forming at least a temporary bond between the at least one heat sink and the thermally-conductive polymer carriage device.

39. The method of claim 37, further comprising augmenting the contact between the at least one heat sink and the thermally-conductive polymer carriage device using at least one compliant, thermally-conductive pad.

40. The method of claim 37, further comprising augmenting the contact between the at least one heat sink and the thermally-conductive polymer carriage device using at least one thermally-conductive heat sink compound.

41. The method of claim 37, further comprising augmenting the contact between the at least one heat sink and the thermally-conductive polymer carriage device using at least one mechanical device or structure.

* * * * *